US006941682B2

(12) United States Patent
Chi et al.

(10) Patent No.: US 6,941,682 B2
(45) **Date of Patent: *Sep. 13, 2005**

(54) FOOTWEAR WITH INTEGRATED STITCHDOWN/ATHLETIC BOTTOM CONSTRUCTION

(75) Inventors: Jim J. Chi, Portland, OR (US); David K. Smith, Portland, OR (US)

(73) Assignee: Danner, Inc., Portland, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/822,135

(22) Filed: Apr. 9, 2004

(65) Prior Publication Data

US 2004/0187348 A1 Sep. 30, 2004

Related U.S. Application Data

(60) Continuation of application No. 10/238,480, filed on Sep. 10, 2002, now Pat. No. 6,757,990, which is a division of application No. 09/662,993, filed on Sep. 15, 2000, now Pat. No. 6,484,420.

(51) Int. Cl.[7] ..... A43B 13/28

(52) U.S. Cl. ..... 36/12; 36/21; 36/46.5; 36/91; 36/142 C

(58) Field of Search ..... 36/12, 21, 46.5, 36/91, 142 C, 17 R, 19 R, 17 A, 16, 18, 11, 45, 431; 12/142 B, 142 C, 142 D, 142 J, 142 T, 145

(56) References Cited

U.S. PATENT DOCUMENTS

| | | | |
|---|---|---|---|
| 392,677 | A | 11/1888 | King |
| 406,338 | A | 7/1889 | Cross |
| 1,602,675 | A | 10/1926 | Hurley |
| 1,709,735 | A | 4/1929 | Parlante |
| 2,005,048 | A | 6/1935 | Randall |

(Continued)

OTHER PUBLICATIONS

ARS sutoria, Issue 114, p. 27, Dec. 1975, Milan, Italy.
ARS sutoria, Issue 211, p. 148, Jun. 1991, Milan, Italy.
ARS sutoria, Issue 223, p. 165, Jan. 1993, Milan Italy.

(Continued)

*Primary Examiner*—Jila M. Mohandesi
(74) *Attorney, Agent, or Firm*—Perkins Coie LLP

(57) ABSTRACT

An upper/insole assembly for use in constructing an article of footwear includes an upper and an insole. The upper has an inner surface, an outer surface, a lateral peripheral flange, and a medial peripheral flange. The insole has a top surface, a bottom surface, a lateral peripheral edge, a medial peripheral edge, an arch portion, a phalangeal portion, and a heel portion. At least a portion of the lateral and medial peripheral flanges of the upper are stitched to the insole in the phalangeal and heel portions but they are not stitched to the insole through the arch portion. Additionally, the lateral peripheral flange of the upper is wrapped around the lateral peripheral edge of the insole in the arch portion and the medial peripheral flange of the upper is wrapped around the medial peripheral edge of the insole in the arch portion. Moreover, the lateral and medial peripheral flanges are secured to the bottom surface of the arch portion of the insole. An article of footwear includes the upper/insole assembly and a bottom component that includes an outsole component, a midsole component, and preferably at least one shank that provides support to the arch portion of the upper/insole assembly and article of footwear. At least a portion of the midsole component is fixed to the upper/insole assembly. A method for manufacturing an upper/insole assembly includes stretching an upper over a last such that a lateral peripheral flange and a medial peripheral flange of the upper extend past the edges of a lateral peripheral edge and a medial peripheral edge of an insole; adhesively securing an inner surface of the lateral peripheral flange to a bottom surface of an arch portion of the insole; adhesively securing an inner surface of the medial peripheral flange to the bottom surface of the arch portion of the insole; stitching the upper to a heel portion of the insole; and stitching the upper to a phalangeal portion of the insole.

33 Claims, 19 Drawing Sheets

U.S. PATENT DOCUMENTS

| | | | | | |
|---|---|---|---|---|---|
| 2,038,528 | A | | 4/1936 | McCarthy | |
| 4,869,001 | A | | 9/1989 | Brown | |
| 4,918,776 | A | | 4/1990 | Motoda | |
| 5,729,918 | A | | 3/1998 | Smets | |
| 5,933,896 | A | | 8/1999 | Gallina | |
| 6,055,745 | A | | 5/2000 | Endoh | |
| 6,484,420 | B1 | * | 11/2002 | Chi et al. | 36/12 |
| 6,757,990 | B2 | * | 7/2004 | Chi et al. | 36/12 |

OTHER PUBLICATIONS

ARS sutoria, Issue 235, p. 209 Jun. 1994, Milan, Italy.
ARS sutoria, Issue 84, p. 88–89, Mar. 1969, Milan Italy.
ARS sutoria, De Grande Produzoine, p. 149, Milan, Italy.
Foto Shoe, Calza® natura Stepper, Stilman, Feb. 2, 1991.
Foto Shoe, Calza®–natura Stepper, Stilman S.p.A.; Dandy Boot®, Lavorazione Artigiana, Aug. 8, 1990.
Rockport ProWalker Brochere, "The ProWalker 7000," 1978, Rockport Walking Institute, Marlboro, Massachusetts.

* cited by examiner

FOOTWEAR WITH INTEGRATED STITCHDOWN/ATHLETIC BOTTOM CONSTRUCTION

CROSS REFERENCE TO RELATED APPLICATION

The present invention is a continuation of U.S. application Ser. No. 10/238,480, filed on Sep. 10, 2002 now U.S. Pat. No. 6,757,990, entitled "Footwear with Integrated Stitchdown/Athletic Bottom Construction," incorporated herein by reference in its entirety, which is a divisional of U.S. application Ser. No. 09/662,993, filed on Sep. 15, 2000 entitled "Footwear with Integrated Stitchdown/Athletic Bottom Construction", now issued as U.S. Pat. No. 6,484,420 on Nov. 26, 2003, incorporated herein by reference in its entirety.

FIELD OF THE INVENTION

The present invention relates to upper/insole assemblies for use in constructing articles of footwear that integrate stitchdown construction methods with athletic bottom components and methods for producing such articles of footwear and upper/insole assemblies.

BACKGROUND OF THE INVENTION

Articles of footwear have been designed and worn by humans since very early in recorded history. Articles of footwear were initially designed to protect the tender bottom portion of the feet of wearers while walking or running over rough surfaces. Although the primary purpose of footwear remains basically unchanged, the various types of activity and surfaces in which humans run, walk, or stand on have led to an ever increasing diversity in the style and construction of footwear. Footwear construction and design have also focused on providing better ankle and arch support while retaining flexibility. Fashion and personal taste have also played significant roles leading to the increase in types of footwear.

Humans engage in a wide variety of physical activities. Some of these activities include walking, running, jogging, sprinting and other track and filed events, backpacking, playing tennis, cross-training, golfing, playing soccer, and scuba diving. Footwear has been specifically designed for use in each of these activities. Methods for constructing footwear have been developed to provide the best characteristics necessary for the particular end use. Thus, methods for constructing boots, athletic shoes, waders, moccasins, slippers, dress shoes, and sandals have all developed.

While many different types of footwear have been designed for specific uses, there is still a need for articles of footwear that will adequately serve the needs of a wearer under varying conditions. For example, many boots are specifically made for activities associated with hiking or backpacking. While such articles of footwear are excellent for this type of activity, an owner of such a boot would probably not want to wear it while playing tennis or engaging in track and field activities due to the weight and decreased flexibility of such an article of footwear. A need still remains for articles of footwear that have improved characteristics which enable them to be better used over a variety of different activities.

One challenge associated with the design of footwear for use in various activities such as in cross-training is providing the necessary arch support while maintaining acceptable weight parameters. Thus, a need remains for an article of footwear for use in cross-training activities that has a reduced weight compared to conventional articles of such footwear yet which also provides adequate arch support. A need for a method for constructing such a reduced weight article of footwear also exists.

SUMMARY OF THE INVENTION

The present invention provides upper/insole assemblies, articles of footwear containing the upper/insole assemblies, and methods for manufacturing the upper/insole assemblies and articles of footwear.

An upper/insole assembly for use in constructing an article of footwear includes an upper and an insole. The upper includes an inner surface; an outer surface; a lateral peripheral flange; and a medial peripheral flange. The insole includes a top surface; a bottom surface; a lateral peripheral edge; a medial peripheral edge; an arch portion; a phalangeal portion; and a heel portion. At least a portion of the lateral and medial peripheral flanges of the upper of the upper/insole assembly are stitched to the insole in the phalangeal and heel portions, but the lateral and medial peripheral flanges are not stitched to the insole through the arch portion. The lateral peripheral flange of the upper is wrapped around the lateral peripheral edge of the insole in the arch portion and the medial peripheral flange of the upper is wrapped around the medial peripheral edge of the insole in the arch portion. Additionally, the lateral and medial peripheral flanges are secured to the bottom surface of the arch portion of the insole.

An article of footwear according to the present invention includes an upper/insole assembly as described in the preceding paragraph and a bottom component that includes an outsole component and a midsole component. At least a portion of the midsole component is fixed to the upper/insole assembly. In more preferred articles of footwear, the bottom component further includes at least one shank that provides support to the arch portion of the upper/insole assembly and article of footwear.

In still other preferred articles of footwear, the bottom component further includes a heel portion and substantially all the heel portion of the bottom component is stitched to the lateral and medial peripheral flanges of the upper through the heel portion of the insole component. In still other preferred articles of footwear, the bottom component also includes a phalangeal portion and substantially all the phalangeal portion of the bottom component is stitched to the lateral and medial peripheral flanges of the upper through the phalangeal portion of the insole component. In still other preferred articles of footwear according to the present invention, the bottom component includes a heel portion and a phalangeal portion and both portions are stitched to the lateral and medial peripheral flanges of the upper through the corresponding heel and phalangeal portions of the insole component.

In some preferred upper/insole assemblies for use in constructing an article of footwear, at least a portion of the lateral and medial peripheral flanges are wrapped around the lateral and medial peripheral edges of the phalangeal portion of the insole and are secured to the bottom surface of the phalangeal portion of the insole. Articles of footwear constructed using such preferred upper/insole assemblies include a bottom component having a midsole component, an outsole component, a heel portion, and a phalangeal portion and substantially all the heel portion of the bottom component is stitched to the lateral and medial peripheral flanges of the upper through the heel portion of the insole component. Additionally, the phalangeal portion of the bottom component is fixed to the phalangeal portion of the insole.

In still other preferred upper/insole assemblies, at least a portion of the lateral and medial peripheral flanges are wrapped around the lateral and medial peripheral edges of the heel portion of the insole and secured to the bottom surface of the heel portion of the insole. Articles of footwear constructed using such an upper/insole assembly include a bottom component having a midsole component, an outsole component, a heel portion and a phalangeal portion. In such articles of footwear, substantially all the phalangeal portion of the bottom component is stitched to the lateral and medial peripheral flanges of the upper through the phalangeal portion of the insole component and the heel portion of the bottom component is fixed to the heel portion of the insole.

In yet other preferred upper/insole assemblies, at least a portion of the lateral and medial peripheral flanges are wrapped around the lateral and medial peripheral edges of the heel and phalangeal portion of the insole and secured to the bottom surface of both the heel and the phalangeal portions of the insole. Articles of footwear constructed from such an upper/insole assembly include a bottom component having a midsole component, an outsole component, a heel portion and a phalangeal portion. In such articles of footwear, the phalangeal portion of the bottom component is fixed to the phalangeal portion of the bottom surface of the insole and the heel portion of the bottom component is fixed to the heel portion of the bottom surface of the insole. Additionally, the outer surface of the lateral and medial peripheral flanges of the upper contacts the top surface of the bottom component.

In yet other preferred upper/insole assemblies, the upper also includes a peripheral toe flange and a peripheral heel flange and the lateral peripheral flange, the medial peripheral flange, the peripheral toe flange and the peripheral heel flange together provide a flange substantially surrounding the perimeter of the upper. In more preferred upper, insole assemblies of this type, the peripheral flanges are wrapped around the lateral and peripheral edges of the insole and the inner surface of each of the peripheral flanges of the upper is secured to the bottom surface of the insole. Articles of footwear constructed using such upper/insole assemblies include a bottom component having a midsole component and an outsole component, and the bottom component is fixed to the bottom surface of the insole. Additionally, the bottom component contacts the outer surface of the peripheral flanges in such articles of footwear.

A method for manufacturing an upper/insole assembly for use in constructing an article of footwear, includes: stretching an upper over a last such that a lateral peripheral flange and a medial peripheral flange of the upper extend past the edges of a lateral peripheral edge and a medial peripheral edge of an insole; adhesively securing an inner surface of the lateral peripheral flange to a bottom surface of an arch portion of the insole; adhesively securing an inner surface of the medial peripheral flange to the bottom surface of the arch portion of the insole; stitching the upper to a heel portion of the insole and a phalangeal portion of the insole, but not to the arch portion of the insole.

A preferred method for manufacturing an article of footwear includes the procedure set forth in the preceding paragraph. In this method for manufacturing an article of footwear, the step of stitching the upper to the heel portion of the insole further includes stitching the upper to a heel portion of a bottom component having a midsole component and an outsole component, and the step of stitching the upper to the phalangeal portion of the insole further includes stitching the upper to a phalangeal portion of the bottom component.

Another preferred method for manufacturing an upper/insole assembly for use in constructing an article of footwear further includes adhesively securing a portion of the inner surface of the lateral and medial peripheral flanges of the upper to the bottom surface of the heel portion of the insole. Methods for manufacturing articles of footwear include following this procedure for manufacturing an upper/insole assembly and also include adhesively securing a heel portion of a bottom component having a phalangeal portion, an outsole component, and a midsole component to the bottom surface of the heel portion of the insole. Additionally, in this method for manufacturing an article of footwear, the step of stitching the upper to the phalangeal portion of the insole further comprises stitching the phalangeal portion of the bottom component to the upper.

Still another preferred method for manufacturing an upper/insole assembly for use in constructing an article of footwear further includes adhesively securing a portion of the inner surface of the lateral and medial peripheral flanges of the upper to the bottom surface of the phalangeal portion of the insole. Methods for manufacturing articles of footwear include following this method for constructing an upper/insole assembly and adhesively securing a phalangeal portion of a bottom component having an outsole component, a midsole component, and a heel portion to the bottom surface of the phalangeal portion of the insole. Additionally, the step of stitching the upper to the heel portion of the insole further comprises stitching the heel portion of the bottom component to the upper.

Yet another method for manufacturing an upper/insole assembly includes adhesively securing a portion of the inner surface of the lateral and medial peripheral flanges of the upper to the bottom surface of the heel and phalangeal portions of the insole. Methods for manufacturing an article of footwear include following this method for manufacturing an upper/insole assembly and adhesively securing a bottom component having an outsole component to the phalangeal and heel portions of the bottom surface of the insole.

In all preferred methods for manufacturing articles of footwear, the bottom component further includes at least one shank with peripheral flanges, and the method further includes adhesively securing the peripheral flanges of the shank to an arch portion of the upper.

Further objects, features and advantages of the invention will be apparent from the following detailed description when taken in conjunction with the drawings.

BRIEF DESCRIPTION OF THE DRAWINGS

The preferred exemplary embodiment of the invention will hereinafter be described in conjunction with the appended drawings, wherein like numerals denote like elements and.

DETAILED DESCRIPTION OF THE INVENTION

Figure 1:
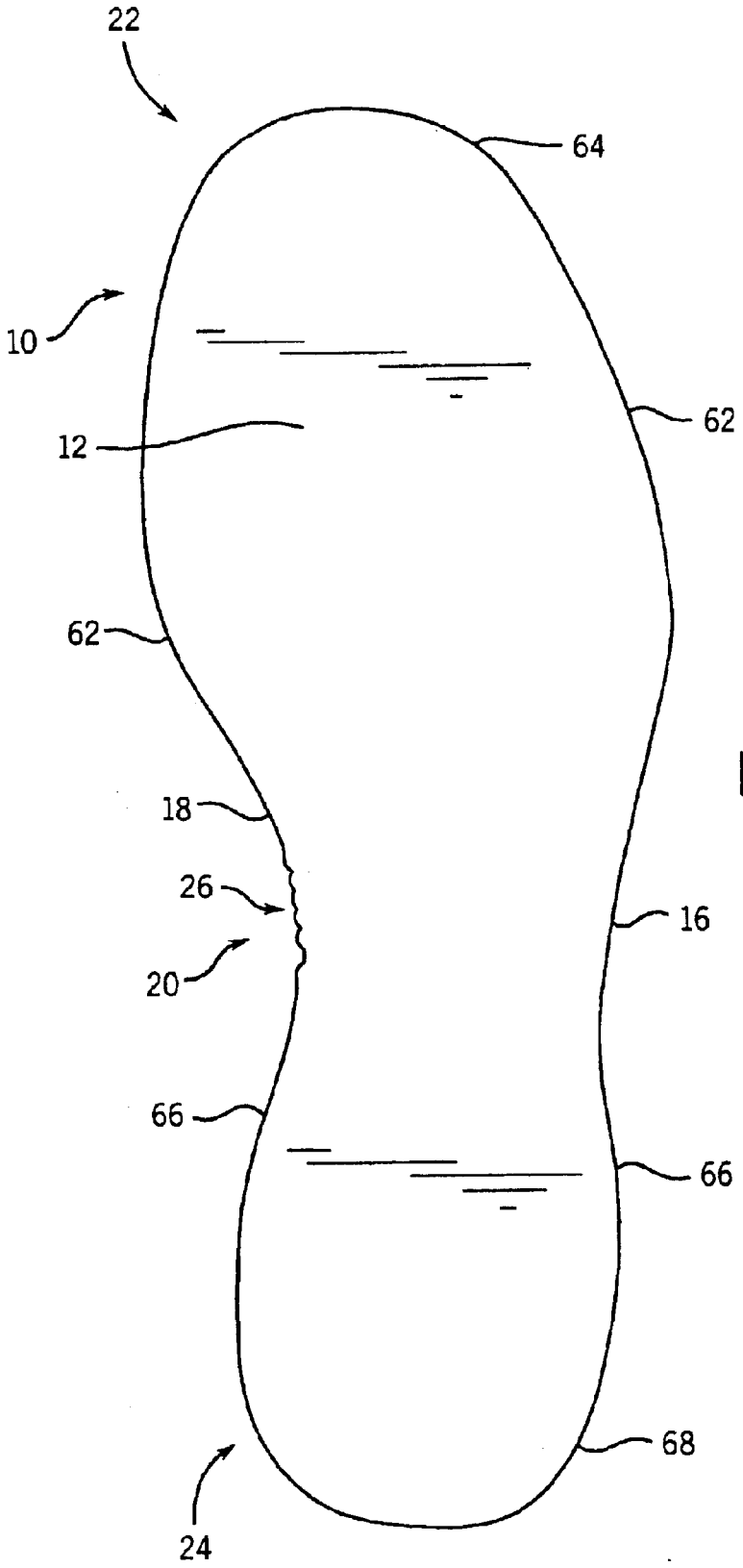
FIG. 1 is a top view of an insole for use in an upper/insole assembly or article of footwear for a right foot according to the present invention.
Figure 2:
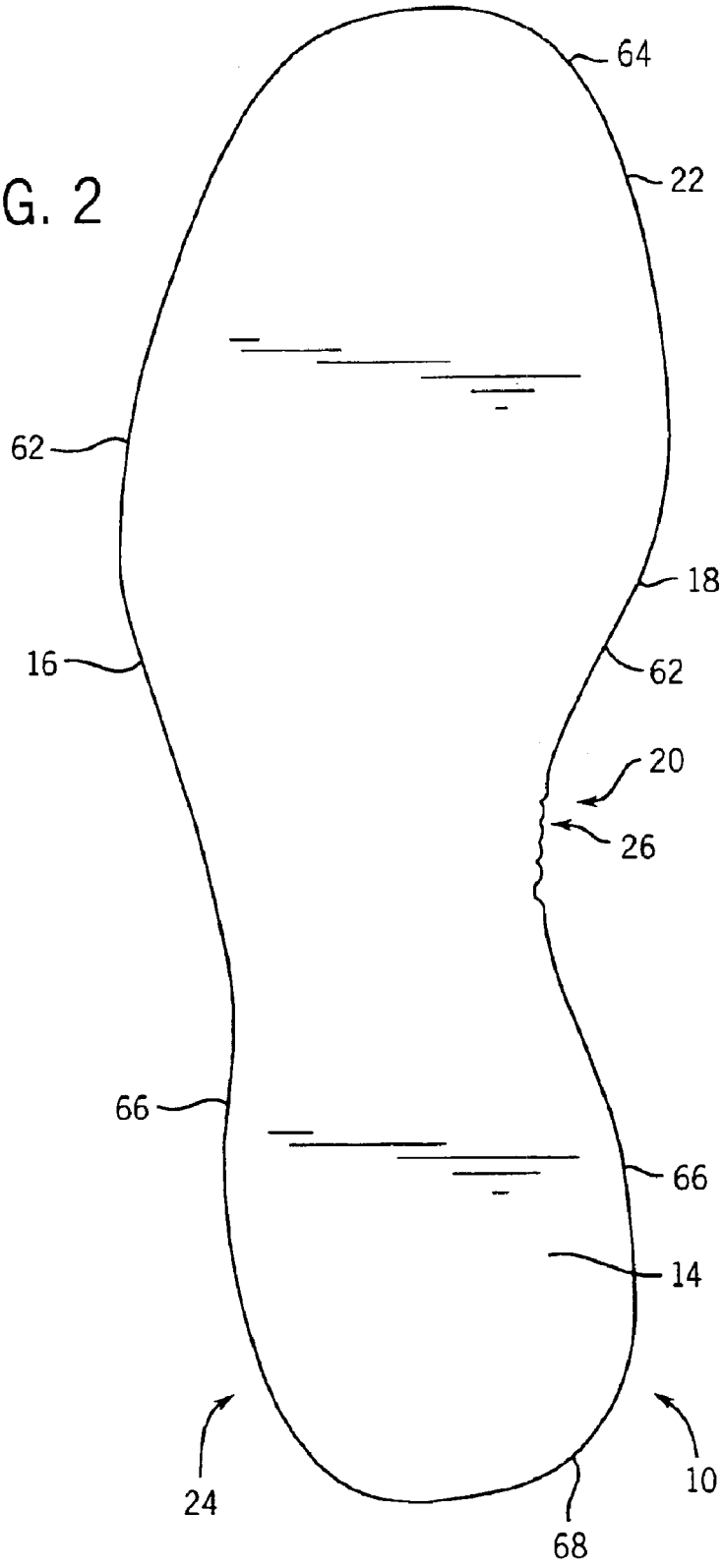
FIG. 2 is a bottom view of the insole shown in FIG. 1.
Figure 3:
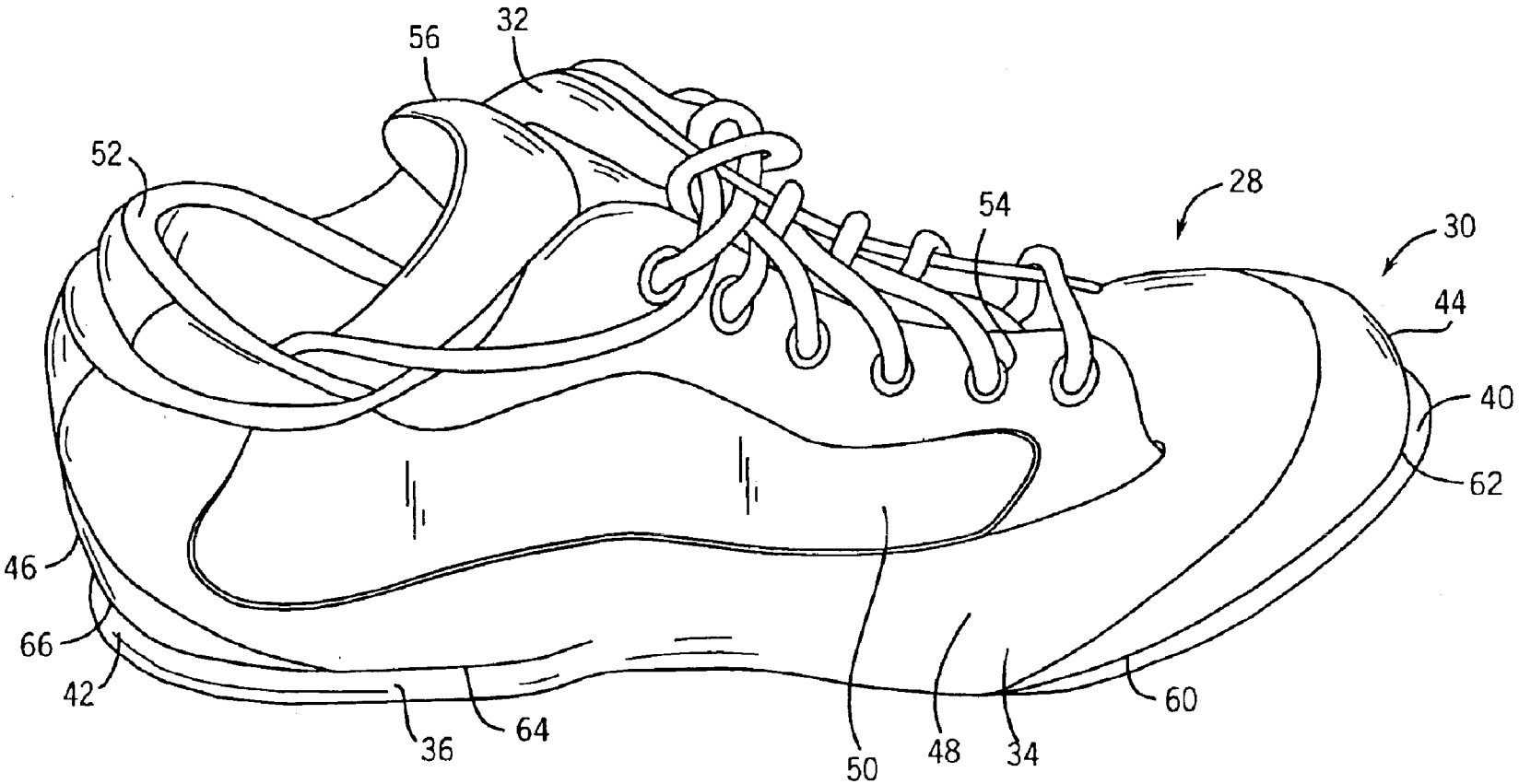
FIG. 3 is a top perspective view of an upper/insole assembly according to the present invention.
Figure 4:
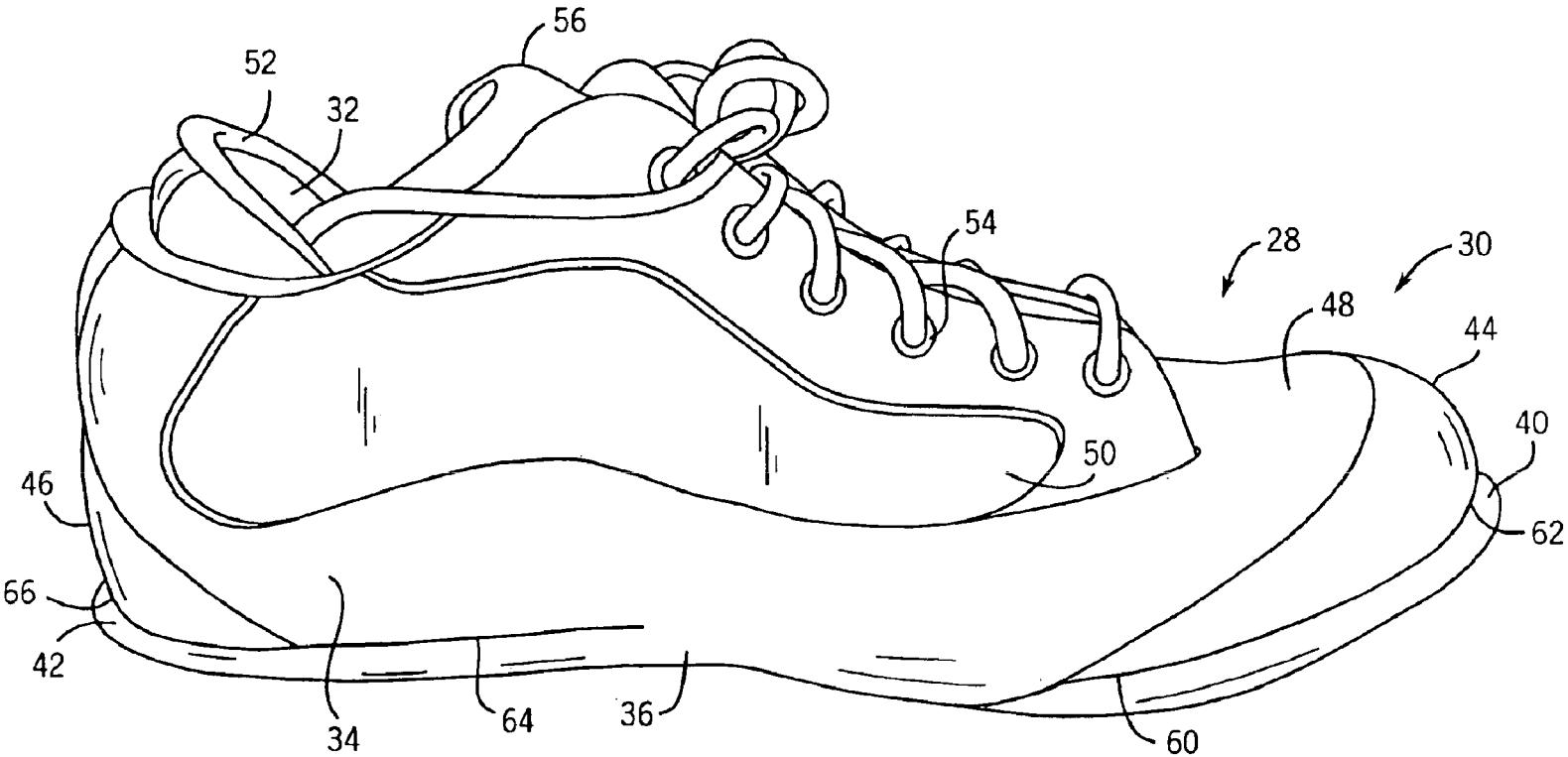
FIG. 4 is right side view of the upper/insole assembly shown in FIG. 3.
Figure 5:
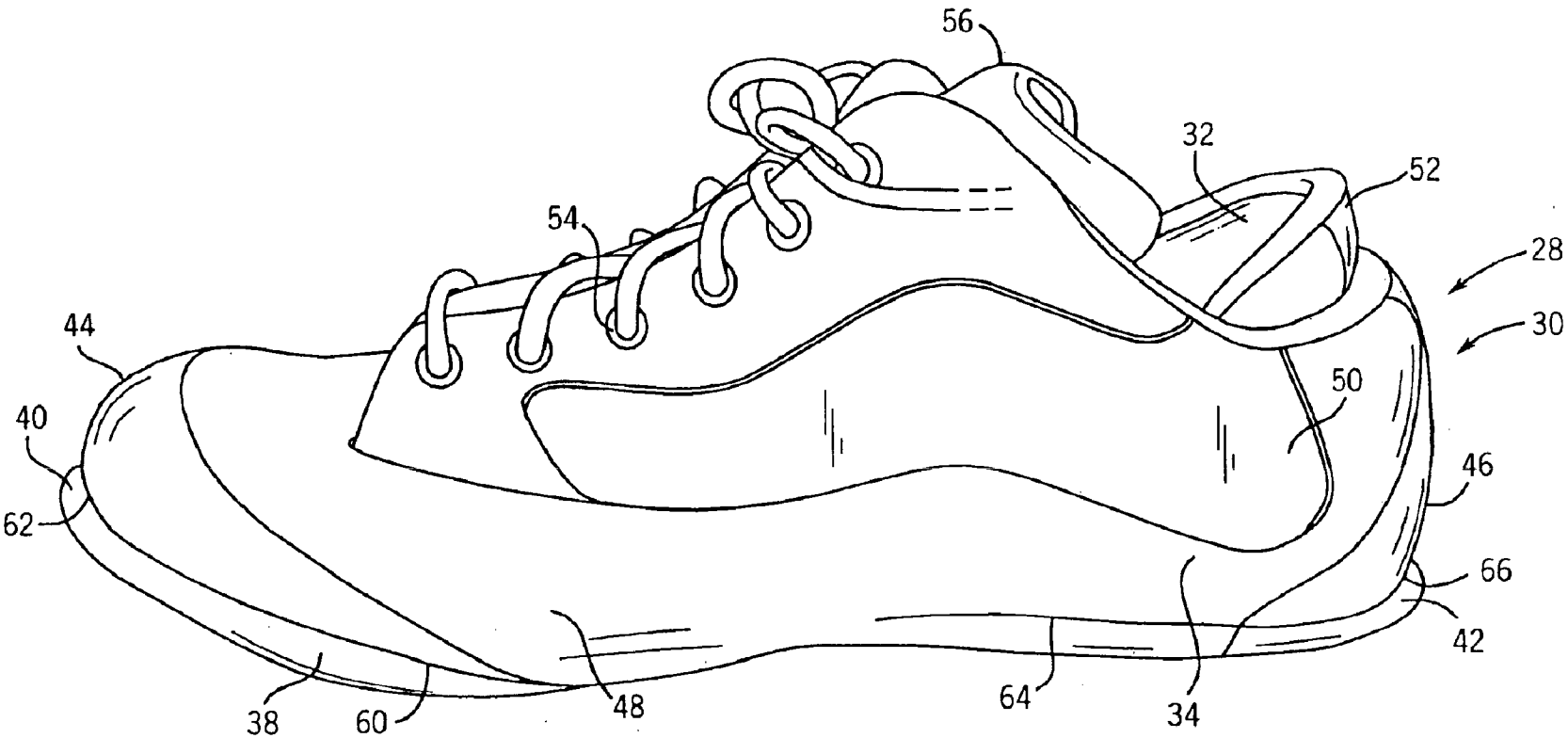
FIG. 5 is a left side view of the upper/insole assembly shown in FIG. 3.

Generally, an upper/insole assembly for use in manufacturing an article of footwear includes an upper and an insole. As shown in FIGS. 1 and 2, an insole 10 for use in the present invention includes a top surface 12, a bottom surface 14, a lateral peripheral edge 16, a medial peripheral edge 18, an arch portion 20, a phalangeal portion 22, and a heel portion 24. Insole 10 can be made from a variety of natural or synthetic materials, including but not limited to, leather, rubber, plastic, molded plastic, pressed paper, cloth or fabrics including woven and non-woven fabrics, other natural or synthetic polymeric materials, and combinations of these materials. The insole is preferably somewhat rigid and more preferably contains notches 26 in arch portion 20 on both the lateral (outer part of foot) and medial (inner part of foot) sides of the insole.

As shown in FIGS. 3–6, upper 28 includes an inner surface 32, an outer surface 34, a lateral peripheral flange 36, and a medial peripheral flange 38. Preferably, upper 28 also includes a peripheral toe flange 40 and a peripheral heel flange 42. As shown in FIGS. 3–5 and 7–9 an upper 28 for use in upper/insole assembly 30 typically includes a toe piece 44, a heel piece 46, and a main upper vamp 48. Additionally, upper 28 may include other features found in conventional articles of footwear including, but not limited to, a fabric piece 50, an achilles pad insert 52, shoe- or boot-lace tabs or eyeholes 54, and a tongue 56. As will be apparent to those skilled in the art, various ornamental and structural features may be included in upper 28 in addition to the above features without departing from the present scope of the invention.

An upper 28 for use in construction of upper/insole assembly 30 or article of footwear 58 shown in FIGS. 7–10 may be constructed of various materials including, but not limited to, leather, cloth or fabric, rubber, other natural or synthetic polymeric materials, and combinations of these materials. A method for manufacturing an upper/insole assembly such as that shown in FIGS. 3–6 typically includes stretching upper 28 over a last so that lateral peripheral flange 36 and medial peripheral flange 38 respectfully extend past the edges of lateral peripheral edge 16 and medial peripheral edge 18 of insole 10. At least a portion of lateral peripheral flange 36 and medial peripheral flange 38 of upper 28 are then stitched to heel portion 24 of insole 10 and to phalangeal portion 22 of insole 10. Preferably, lateral peripheral flange 36 and medial peripheral flange 38 of upper are stitched to the entire heel 24 and phalangeal 22 portions of insole 10 along the peripheral edge of insole 10 in these sections. Thus, in a preferred upper/insole assembly 28, lateral and medial peripheral flanges (36 and 38) are stitched from the rear part 60 of phalangeal portion 22 through toe region 62 of insole 10 along the peripheral edge of insole 10. Similarly, in preferred upper/insole assemblies 28, lateral and medial peripheral flanges (36 and 38) are stitched from the front part 64 of heel portion 24 through back of foot region 66 of insole 10 along the peripheral edge of insole 10. Lateral and medial peripheral flanges (36 and 38) are pulled tight and wrapped under insole 10 during manufacture of upper/insole assemblies. The inner surface of lateral peripheral flange 36 is then adhesively secured to bottom surface 14 of arch portion 20 of insole 10 on the lateral side of insole 10, and the inner surface of medial peripheral flange 38 is adhesively secured to bottom surface 14 of arch portion 20 of insole 10 on the medial side of insole 10. Any method known to those skilled in the art may be used to adhesively secure lateral and medial peripheral flanges (36 and 38) to bottom surface 14 of insole 10 including, but not limited to, hot melt adhesives, cements and other solvent-based adhesives, and combinations of these materials. Upper 28 is not stitched to insole 10 through arch portion 20, but, as described above, upper 28 is stitched to insole 10 through phalangeal portion 22 and heel portion 24 of insole 10. However, as described above, lateral and medial peripheral flanges (36 and 38) are respectively wrapped around lateral and medial peripheral edges (16 and 18) and cemented or otherwise adhesively fixed or secured to bottom surface 14 of insole 10 in arch portion 20. Because the upper is lasted tight to the last in the arch portion, an upper/insole assembly according to the present invention generally has a broad base in the phalangeal and heel portions and a narrow base under the arch portion.

Figure 7:
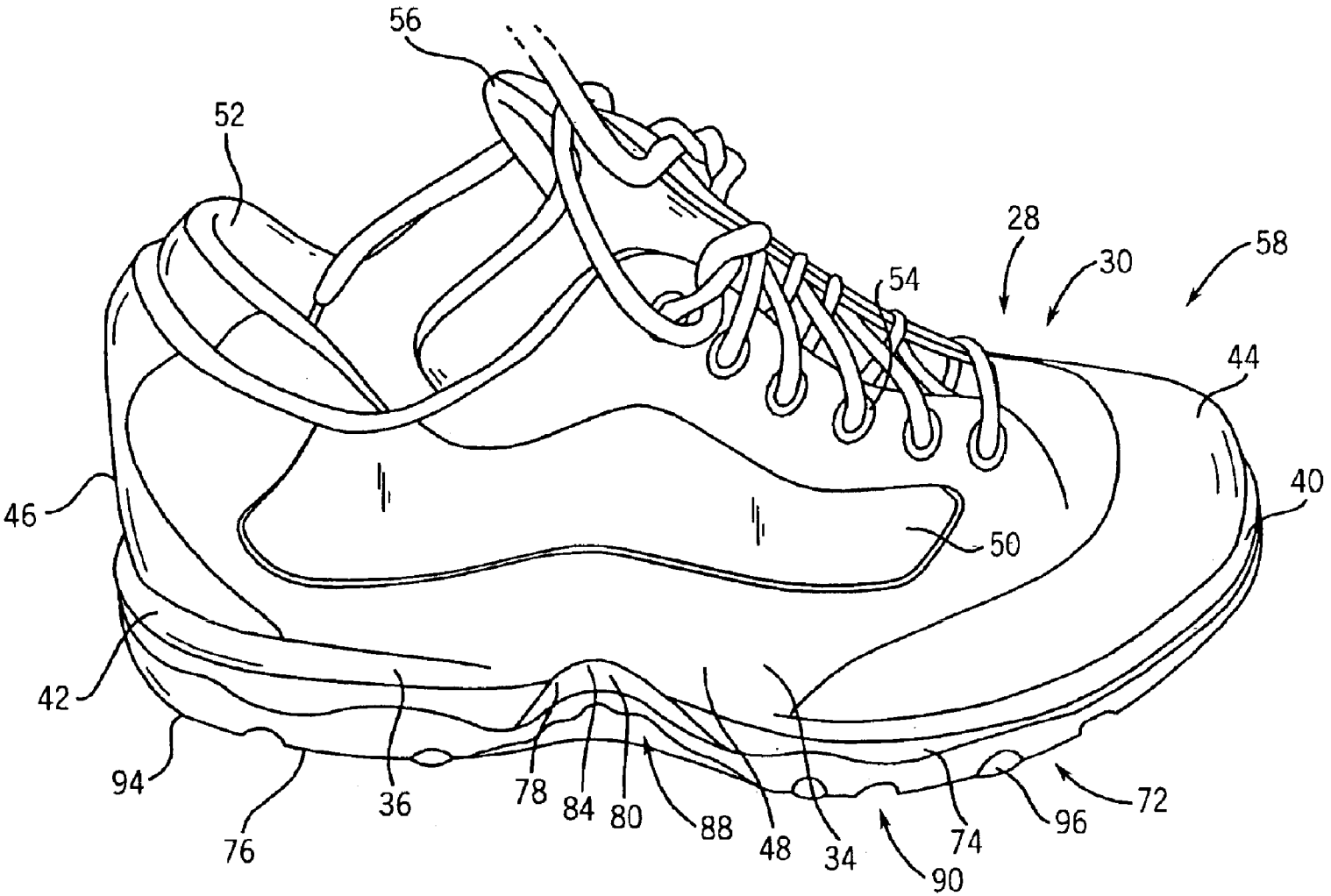
FIG. 7 is a top perspective view of an article of footwear constructed using the upper/insole assembly shown in FIG. 3.
Figure 8:
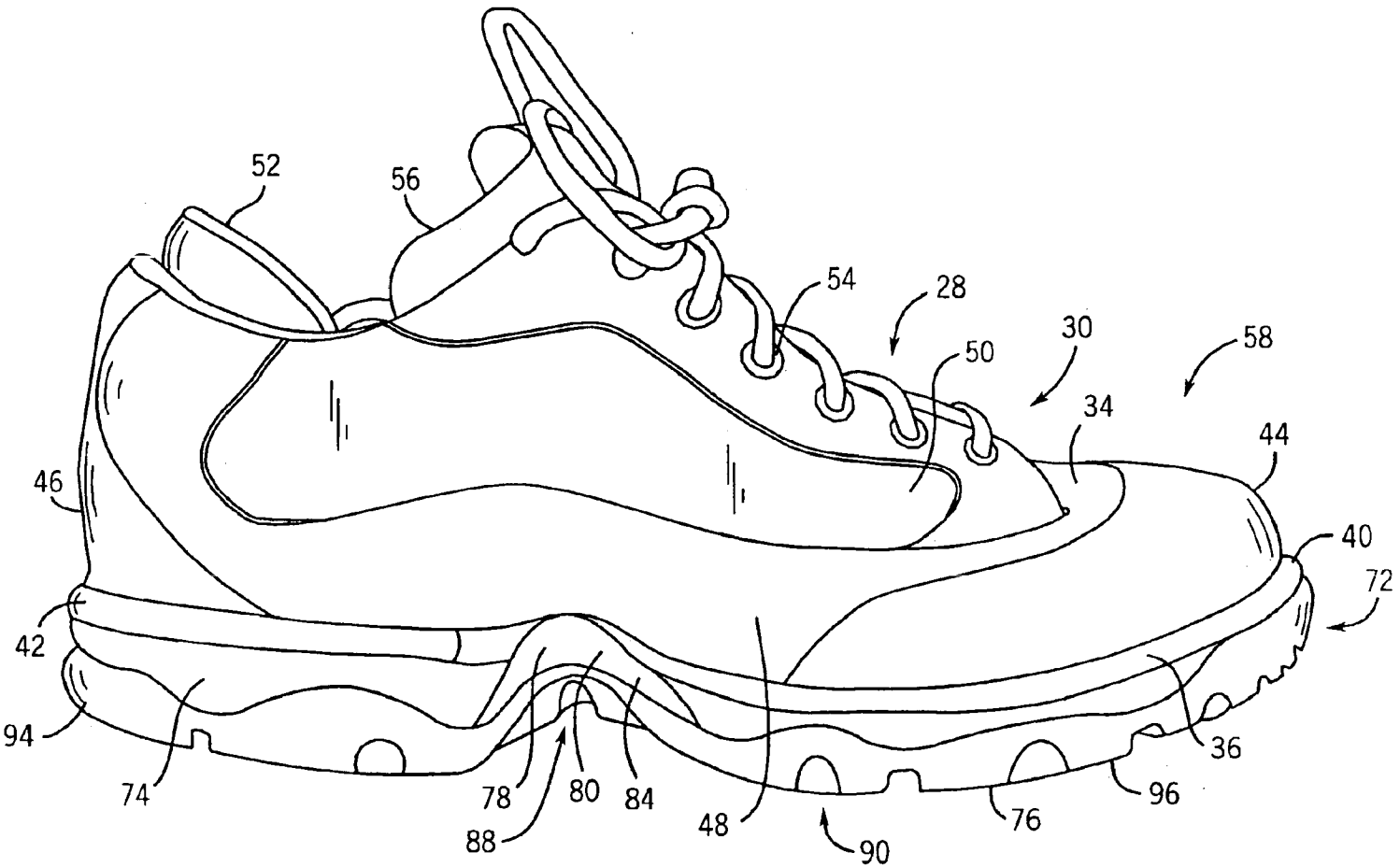
FIG. 8 is a right side view of the article of footwear shown in FIG. 7.
Figure 9:
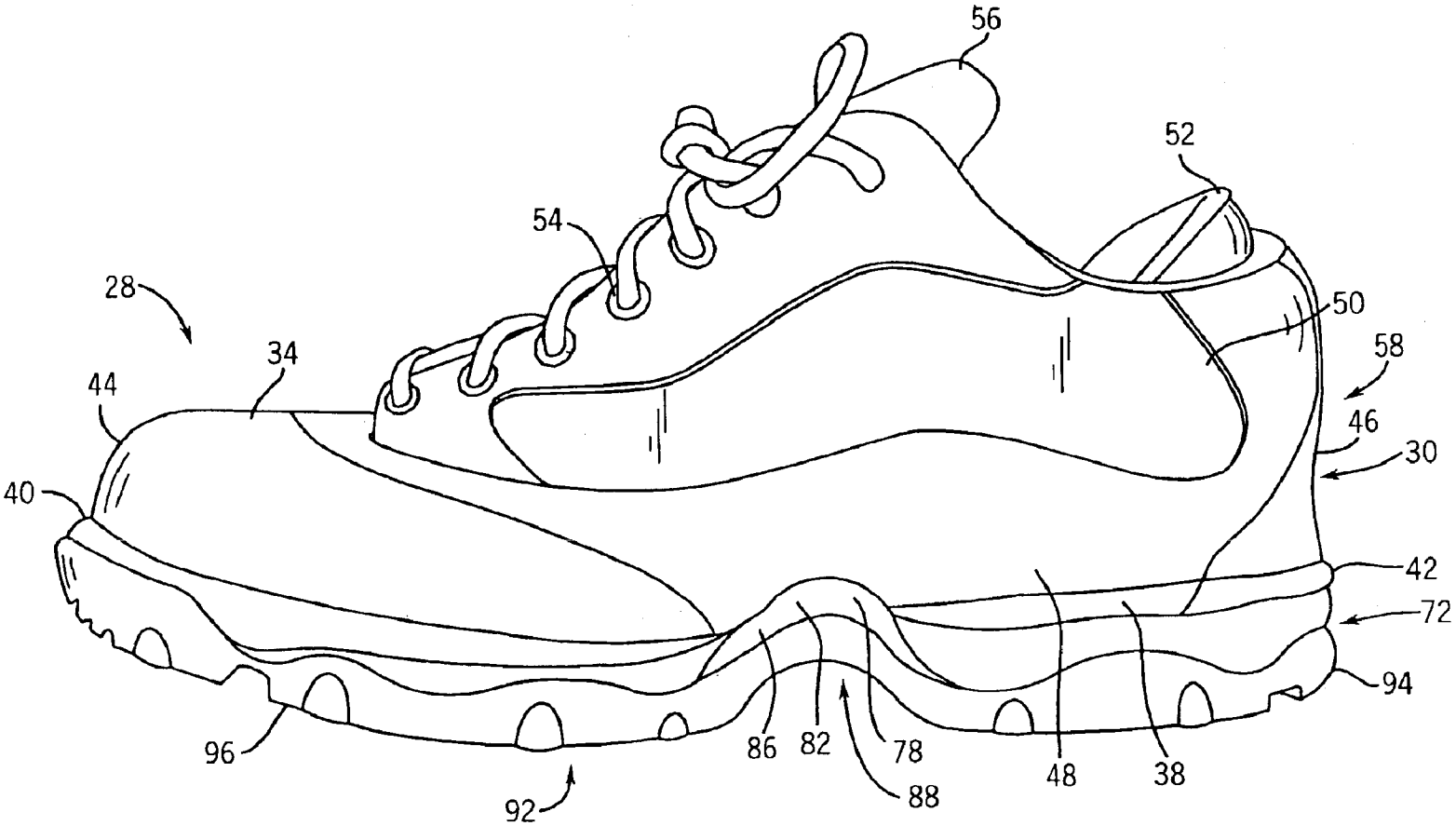
FIG. 9 is a left side view of the article of footwear shown in FIG. 7.
Figure 10:
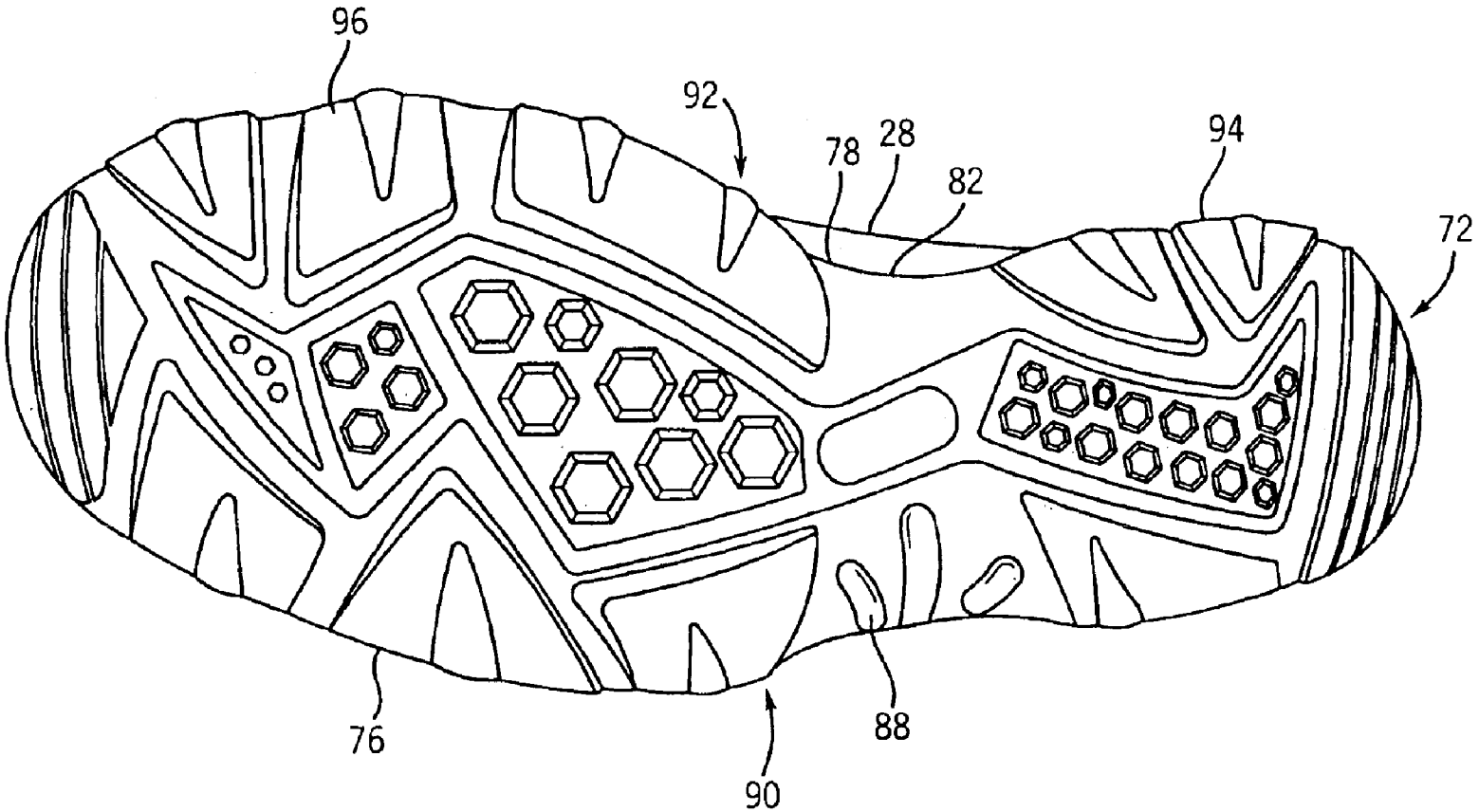
FIG. 10 is a bottom view of the article of footwear shown in FIG. 7.

As shown in FIGS. 7–10, an article of footwear 58 generally includes an upper/insole assembly according to the present invention and a bottom component 72 that includes a midsole component 74 and an outsole component 76. The midsole component may be made of various materials known to those skilled in the art, including, but not limited to, rubber, polyurethane, ethyl vinyl acetate, and other natural or synthetic polymeric materials, and combinations of these materials. The outsole may similarly be made of various materials known to those skilled in the art, including, but not limited to, rubber, other synthetic or natural polymeric materials, and combinations of materials. Preferably, either or both of the midsole and outsole components are molded. Bottom component 72 is preferably fixed, more preferably adhesively fixed, to bottom surface 14 of insole 10 in arch portion 20 of insole 10. Because the bottom component and the bottom surface of the insole of the upper/insole assembly are fixed together, it is highly preferred that the upper/insole assembly and bottom component be manufactured to fit together so that no trimming is required to remove excess material from the bottom component as would generally be done using conventional stitchdown construction methods. Preferred articles of footwear according to the present invention include at least one shank such as external shank 78. Preferred articles of footwear may contain one, two or more shanks which may be internal, external or encapsulated. Different types of shank may be used in a preferred article of footwear. Preferred external shanks include a lateral wing 80 and a medial wing 82 as shown in FIGS. 7–9. Lateral and medial wings (80 and 82) of external shank 78 preferably extend up the sides of upper 28 so that external surfaces (84 and 86) of lateral and medial wings (80 and 82) provide external support to arch region 88 of article of footwear 58. Additionally, in more preferred articles of footwear such as article of footwear 58 shown in FIGS. 7–10 the inner surfaces (not shown) of lateral and medial wings (80 and 82) is adhesively secured to outer surface 34 of upper 28. External shank 78 most preferably extends from lateral side 90 to medial side 92 of article of footwear 58 between midsole component 74 and insole 10 of upper/insole assembly 30. A shank such as external shank 78 is preferably rigid and thus provides good underarch support to the arch portion of an article of footwear constructed according to the present invention. Thus, the amount of midsole in the arch portion of the article of footwear may be reduced. The reduction of the amount of midsole in the arch portion of the article of footwear combined with the narrow arch portion results in lighter articles of footwear that have increased stability and durability. Although various types of footwear may be constructed using the method of the present invention, shoes or boots designed for outdoor cross-training are lighter and more durable than conventional such articles of footwear.

In articles of footwear according to the present invention such as that shown in FIGS. 7–10, at least a portion of midsole component 74 is fixed to upper/insole assembly 30. More preferably, substantially all to all of midsole component 74 is fixed to upper/insole assembly 30 either by adhesive, by stitching or by both adhesive and stitching. In cases where midsole component 74 is stitched to an upper/insole assembly, the stitching may and preferably does extend through midsole component 74. Additionally, where midsole component 74 is stitched to an upper/insole assembly, the stitching may extend partially into or completely through outsole component 76 of bottom component 72.

Figure 6:
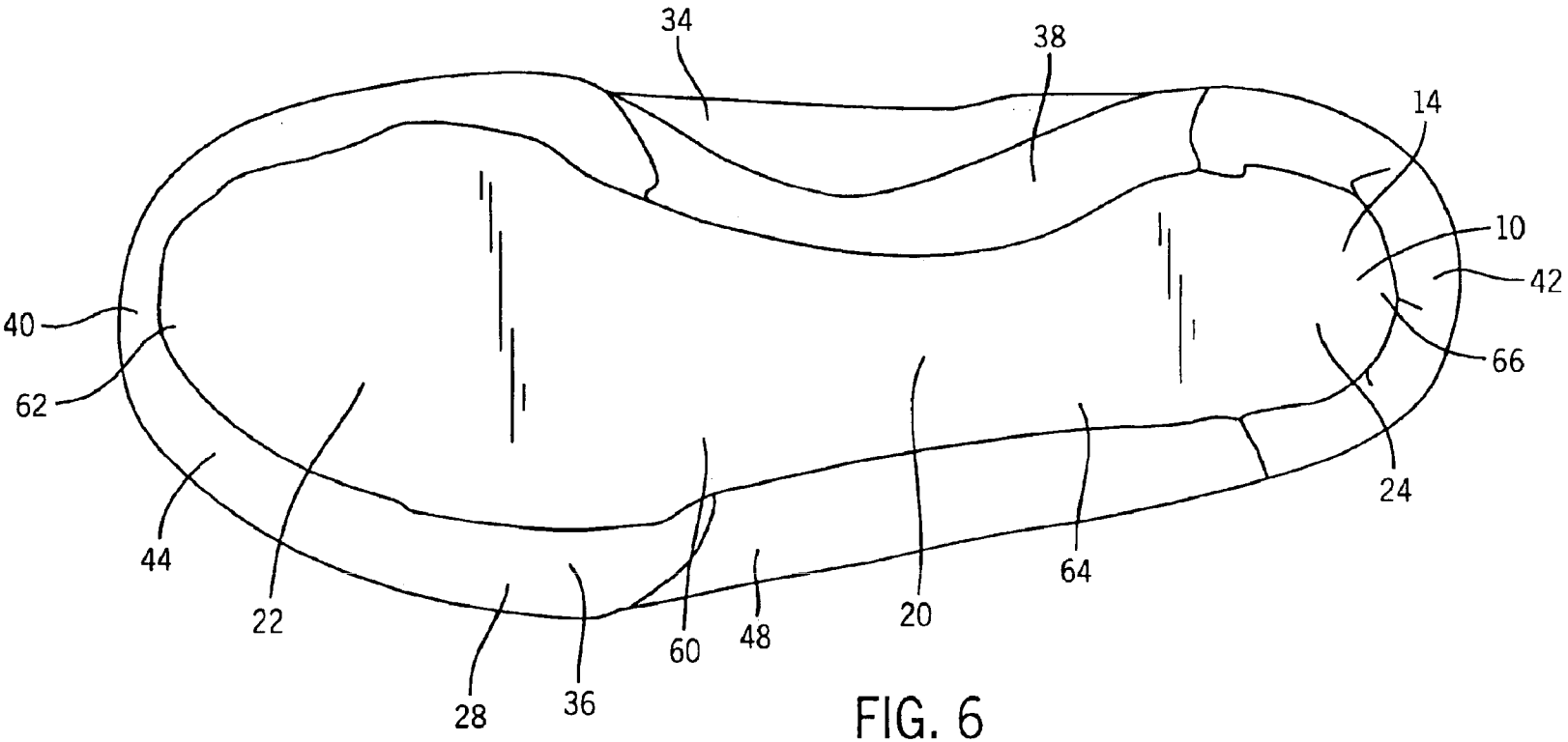
FIG. 6 is a bottom view of the upper/insole assembly shown in FIG. 3.

In some preferred upper/insole assemblies, lateral and medial peripheral flanges (36 and 38) of upper 28 are wrapped around lateral and medial peripheral edges (16 and 18) in both phalangeal and heel portions (22 and 24) of insole 10 and secured, preferably adhesively, to bottom surface 14 of phalangeal and heel portions (22 and 24) of insole 10 as shown in FIG. 6. Articles of footwear constructed from such upper/insole assemblies include bottom component 72 as described above with heel portion 94 and phalangeal portion 96. In such articles of footwear, bottom component 72 is fixed, preferably adhesively, to bottom surface 14 of insole 10 in phalangeal and heel portions (22 and 24) of insole 10.

In highly preferred upper/insole assemblies, the upper 28 includes a peripheral toe flange 40 and a peripheral heel flange 42 such that the lateral peripheral flange 36, the medial peripheral flange 38, the peripheral toe flange 40 and the peripheral heel flange 42 together substantially, or more preferably completely, surround the perimeter of upper 28. In more preferred such upper/insole assemblies, each of the flanges is wrapped around a peripheral edge of insole 10 and is secured, preferably adhesively, to bottom surface 14 of insole 10 as shown in FIG. 6. In articles of footwear 58 constructed from such upper/insole assemblies, bottom component 72 is fixed, preferably adhesively, to bottom surface 14 of insole 10 in phalangeal and heel portions (22 and 24) of insole 10 in addition to being fixed to bottom surface 14 in arch portion 20 of insole 10.

Figure 11:
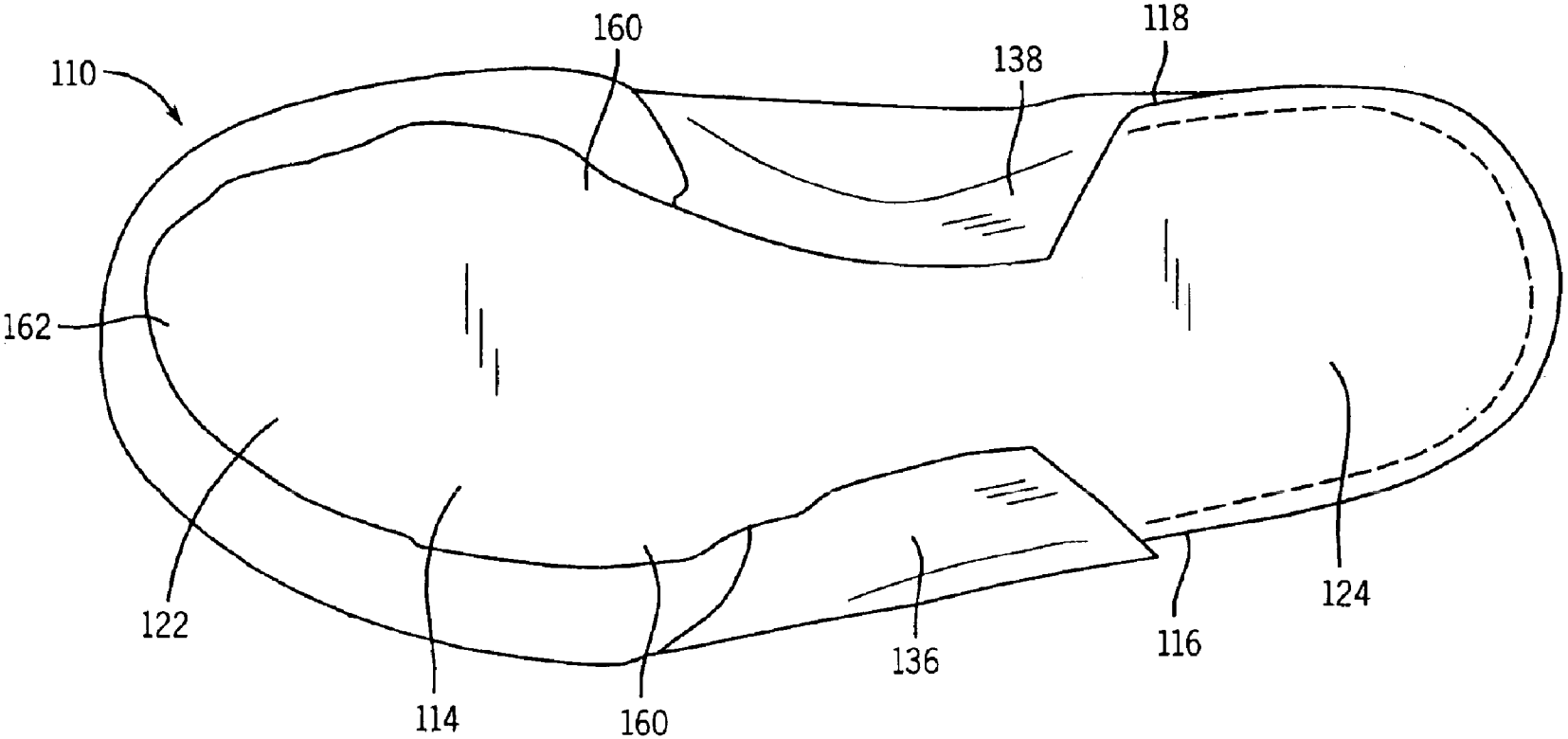
FIG. 11 is a bottom view of an upper/insole assembly according to a first alternative embodiment showing where the upper is stitched to the heel portion of the insole which would extend into the heel portion of a bottom component of an article of footwear constructed from the upper/insole assembly.
Figure 12:
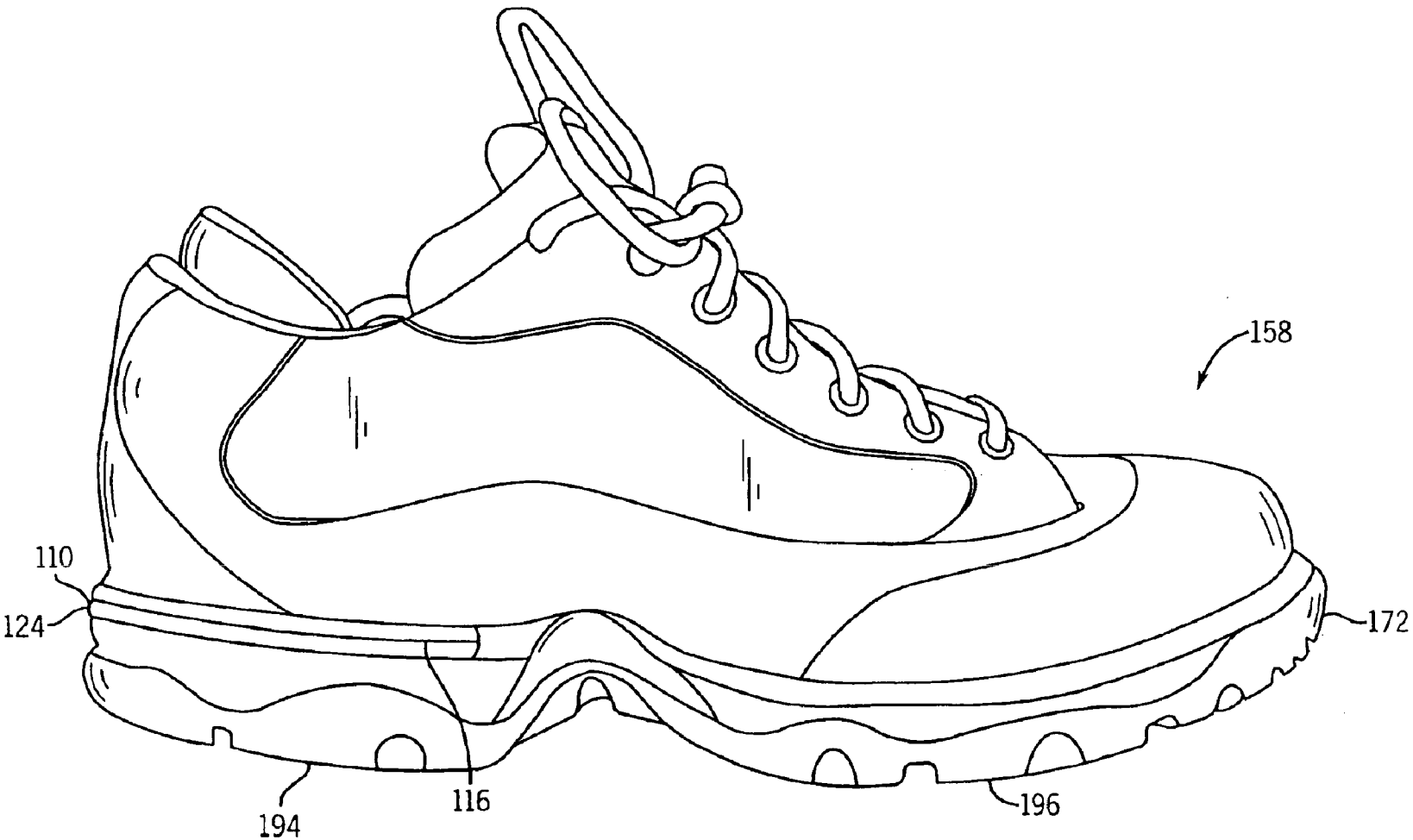
FIG. 12 is a right side view of an article of footwear constructed using the upper/insole assembly shown in FIG. 11.
Figure 13:
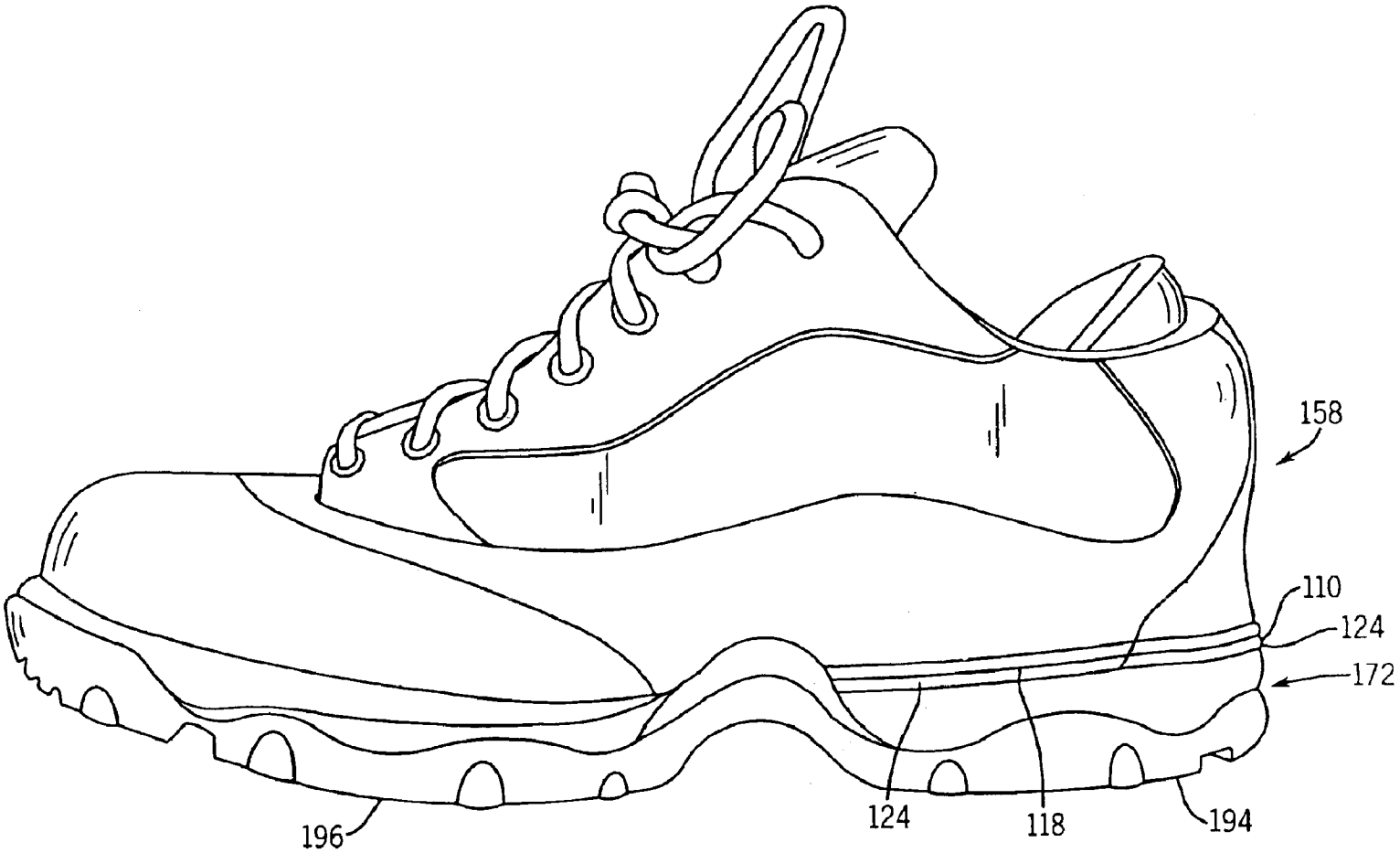
FIG. 13 is a left side view of the article of footwear shown in FIG. 12.

In some preferred upper/insole assemblies such as that shown in FIG. 11, at least a portion of lateral and medial peripheral flanges (136 and 138) are wrapped around lateral and medial peripheral edges (116 and 118) of phalangeal portion 122 of insole 110 and secured, preferably adhesively, to bottom surface 114 of phalangeal portion 122 of insole 110 as shown in FIG. 11. More preferably, lateral and medial peripheral flanges (136 and 138) are wrapped around lateral and medial peripheral edges (116 and 118) of phalangeal portion 122 and adhesively secured to bottom surface 114 of phalangeal portion 122 of insole 110 continuously from rear part 160 through toe region 162 of phalangeal portion 122 of insole 110 as shown in FIG. 11. In such upper/insole assemblies, lateral and medial peripheral flanges (136 and 138) may be similarly wrapped around lateral and medial peripheral edges (116 and 118) of heel portion 124 of insole 110 and secured to bottom surface 114 of heel portion 124 of insole 110. More preferably, lateral and medial peripheral flanges (136 and 138) extend only to the edge of lateral and medial peripheral edges (116 and 118) in heel portion 124 of insole 110 as shown in FIG. 11. As shown in FIGS. 12 and 13, an article of footwear 158 constructed from such an upper/insole assembly include bottom component 172. In such articles of footwear, substantially all to all of heel portion 194 of bottom component 172 is stitched to lateral and medial peripheral flanges (136 and 138) through heel portion 124 of insole 110 along lateral and medial peripheral edges (116 and 118) of insole 110. Preferably, phalangeal portion 196 of bottom component 172 is fixed, preferably adhesively, to bottom surface 114 of phalangeal portion 122 of insole 110 in such articles of footwear.

Figure 14:
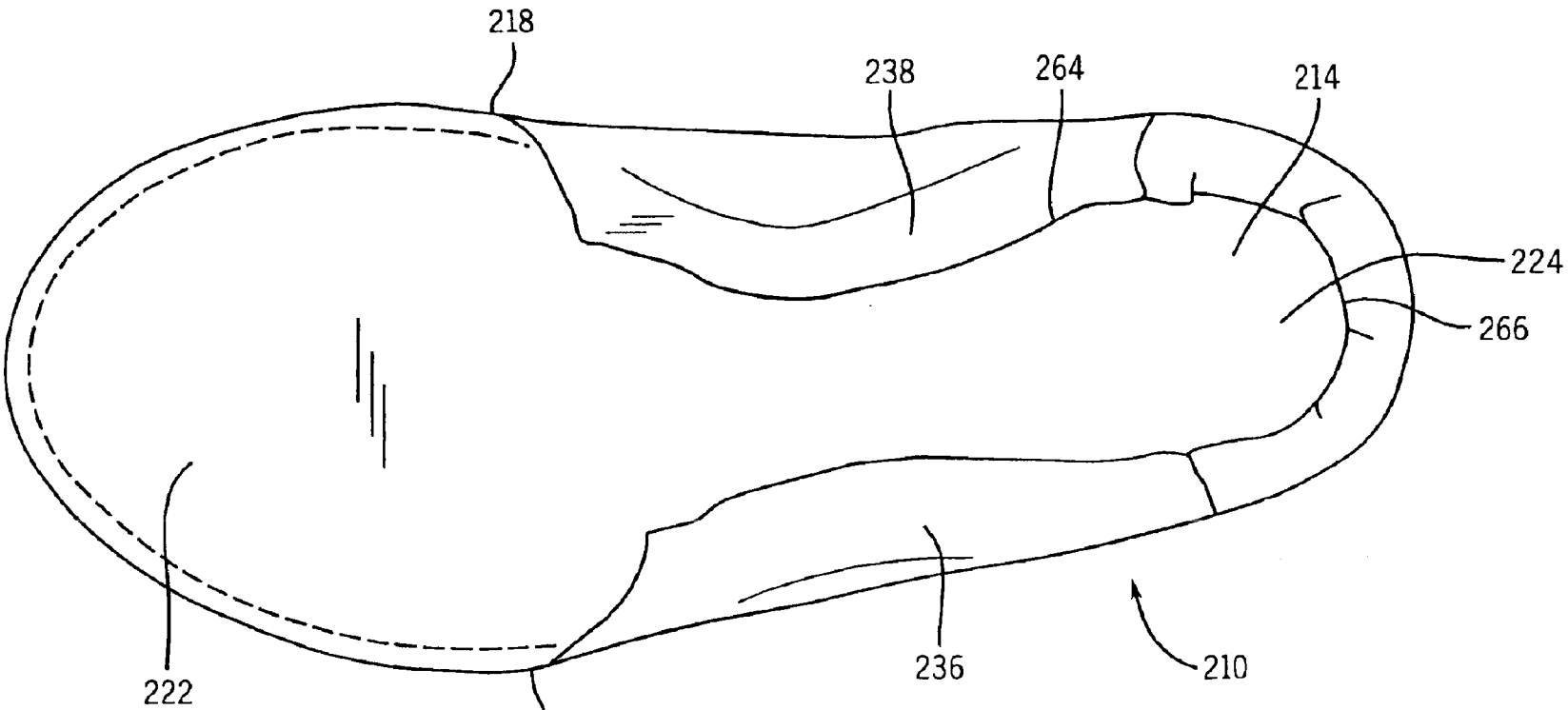
FIG. 14 is a bottom view of an upper/insole assembly according to a second alternative embodiment showing where the upper is stitched to the phalangeal portion of the insole which would extend into the phalangeal portion of a bottom component of an article of footwear constructed from the upper/insole assembly.
Figure 15:
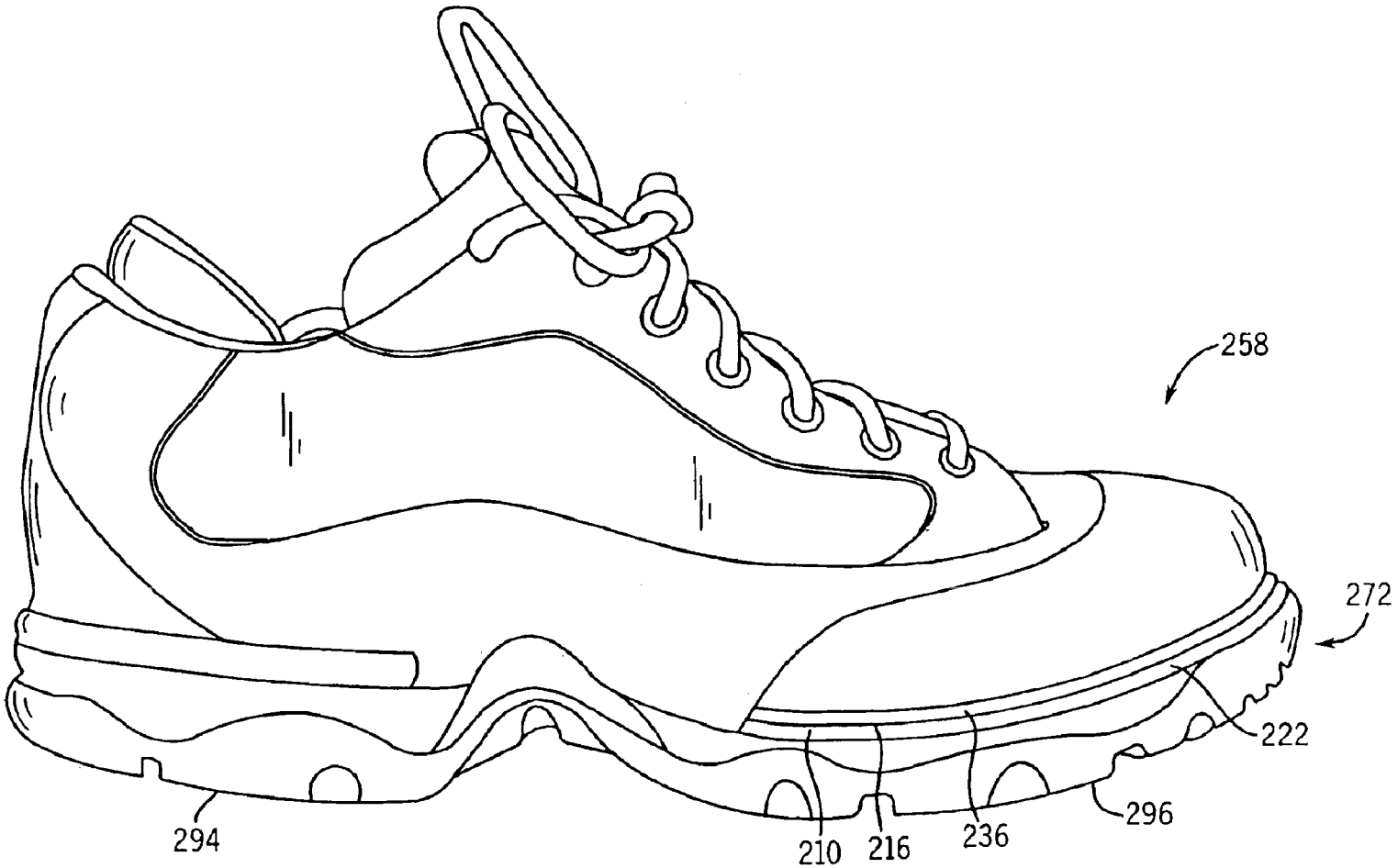
FIG. 15 is a right side view of an article of footwear constructed using the upper/insole assembly shown in FIG. 14.
Figure 16:
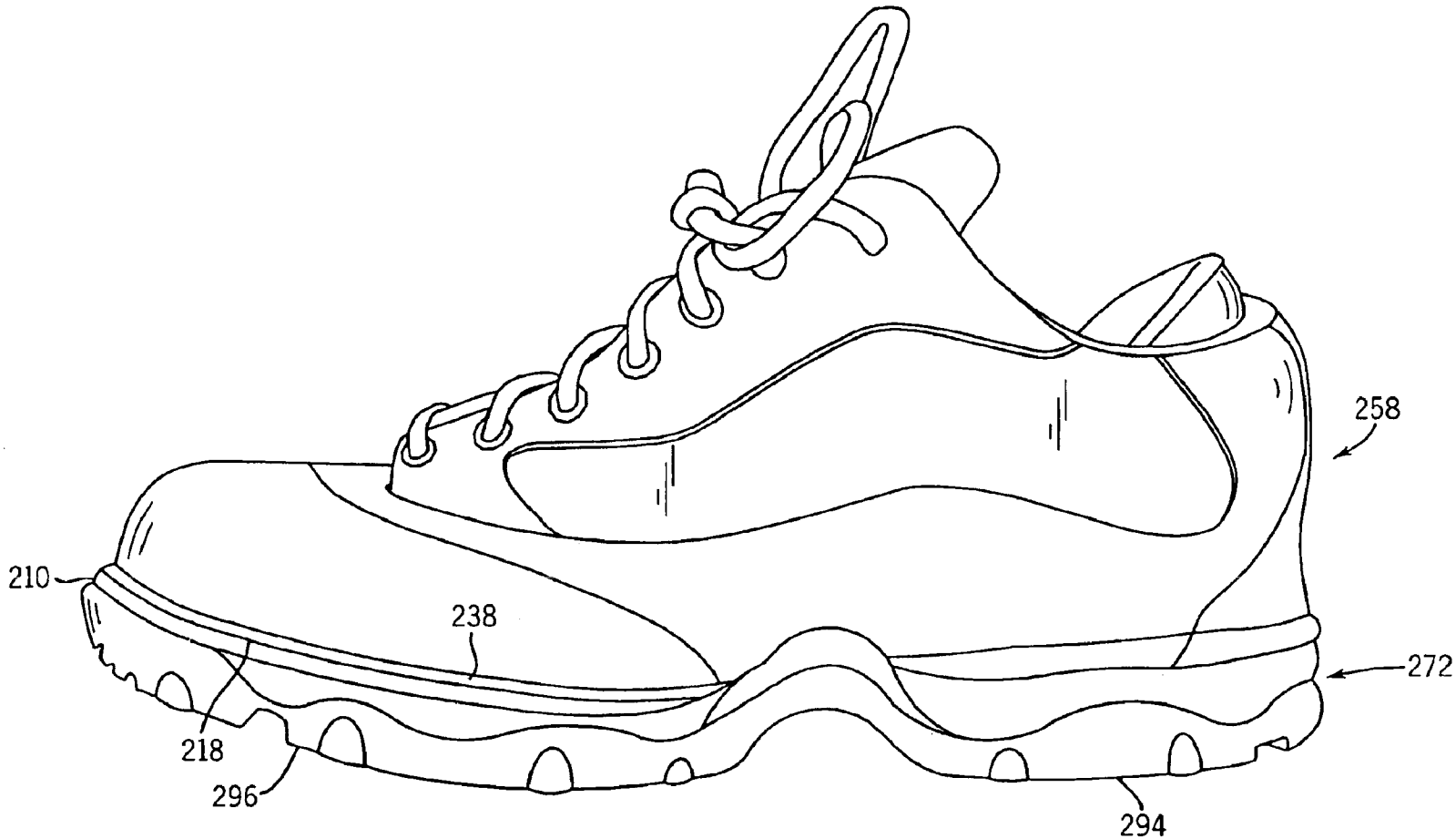
FIG. 16 is a left side view of the article of footwear shown in FIG. 15.

In other preferred upper/insole assemblies 210, at least a portion of lateral and medial peripheral flanges (236 and 238) are wrapped around lateral and medial peripheral edges (216 and 218) of heel portion 224 of insole 210 and secured, preferably adhesively, to bottom surface 214 of heel portion 224 of insole 210 as shown in FIG. 14. More preferably, lateral and medial peripheral flanges (236 and 238) are wrapped around lateral and medial peripheral edges (216 and 218) of heel portion 224 of insole 210 and adhesively secured to bottom surface 214 of heel portion 224 of insole 210 continuously from front part 264 of heel portion 224 of insole 210 through back of foot region 266 of insole 210 as shown in FIG. 14. In such upper/insole assemblies, lateral and medial peripheral flanges (236 and 238) may be similarly wrapped around lateral and medial peripheral edges (216 and 218) of phalangeal portion 222 of insole 210 and secured to bottom surface 214 of phalangeal portion 222 of insole 210. More preferably, lateral and medial peripheral flanges (236 and 238) extend only to the edge of lateral and medial peripheral edges (216 and 218) in phalangeal portion 222 of insole 210 as shown in FIG. 14. As shown in FIGS. 15 and 16, an article of footwear 258 constructed from such an upper/insole assembly includes bottom component 272. In such articles of footwear, substantially all to all of phalangeal portion 296 of bottom component 272 is stitched to lateral and medial peripheral flanges (236 and 238) through phalangeal portion 222 of insole 210 along lateral and medial peripheral edges (216 and 218) of insole 210. Preferably, heel portion 294 of bottom component 272 is fixed, preferably adhesively, to bottom surface 214 of heel portion 224 of insole 210 in such articles of footwear.

Figure 17:
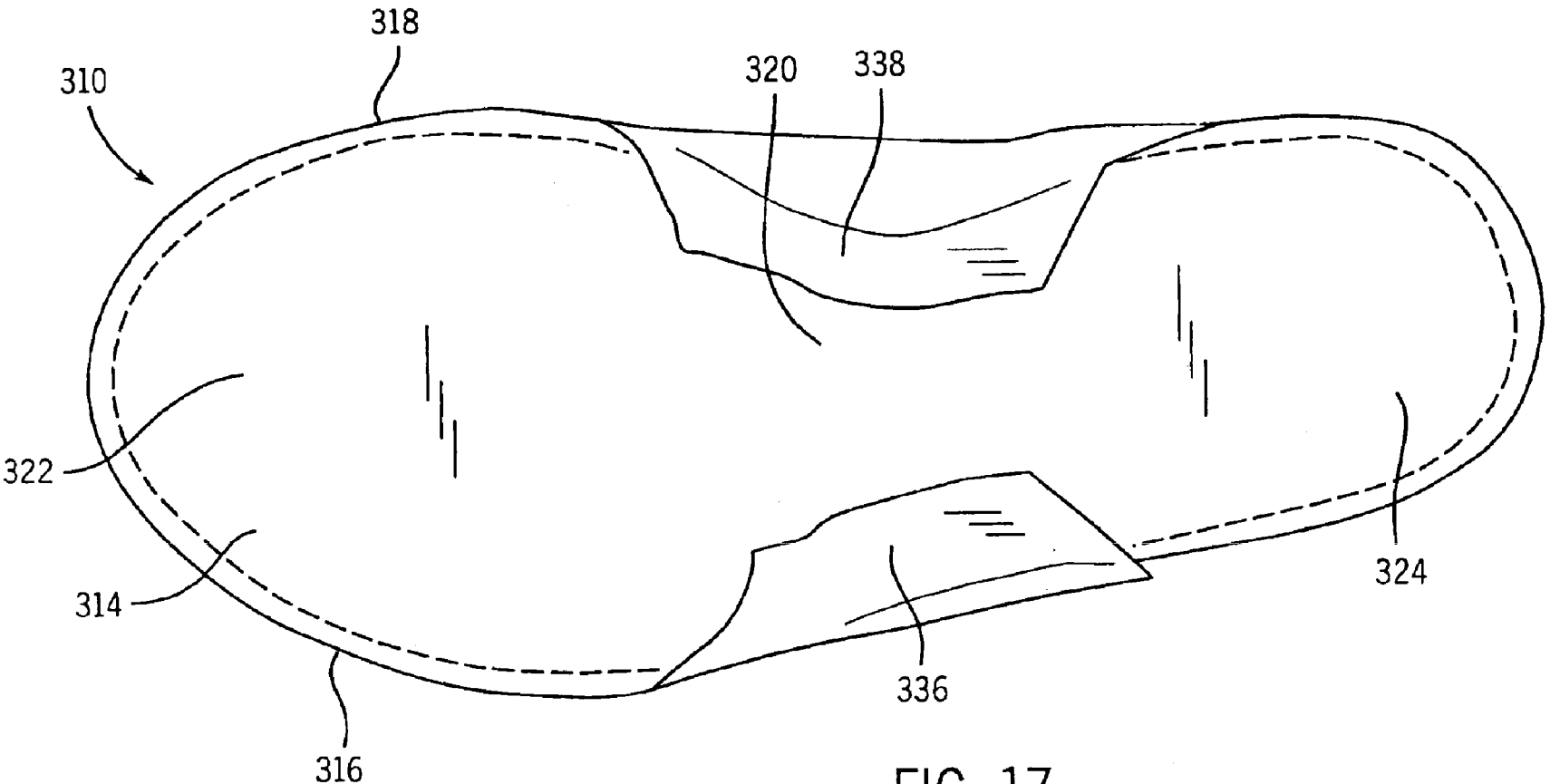
FIG. 17 is a bottom view of an upper/insole assembly according to a third alternative embodiment showing where the upper is stitched to the heel and phalangeal portions of the insole which would extend into the corresponding portions of a bottom component of an article of footwear constructed from the upper/insole assembly.
Figure 18:
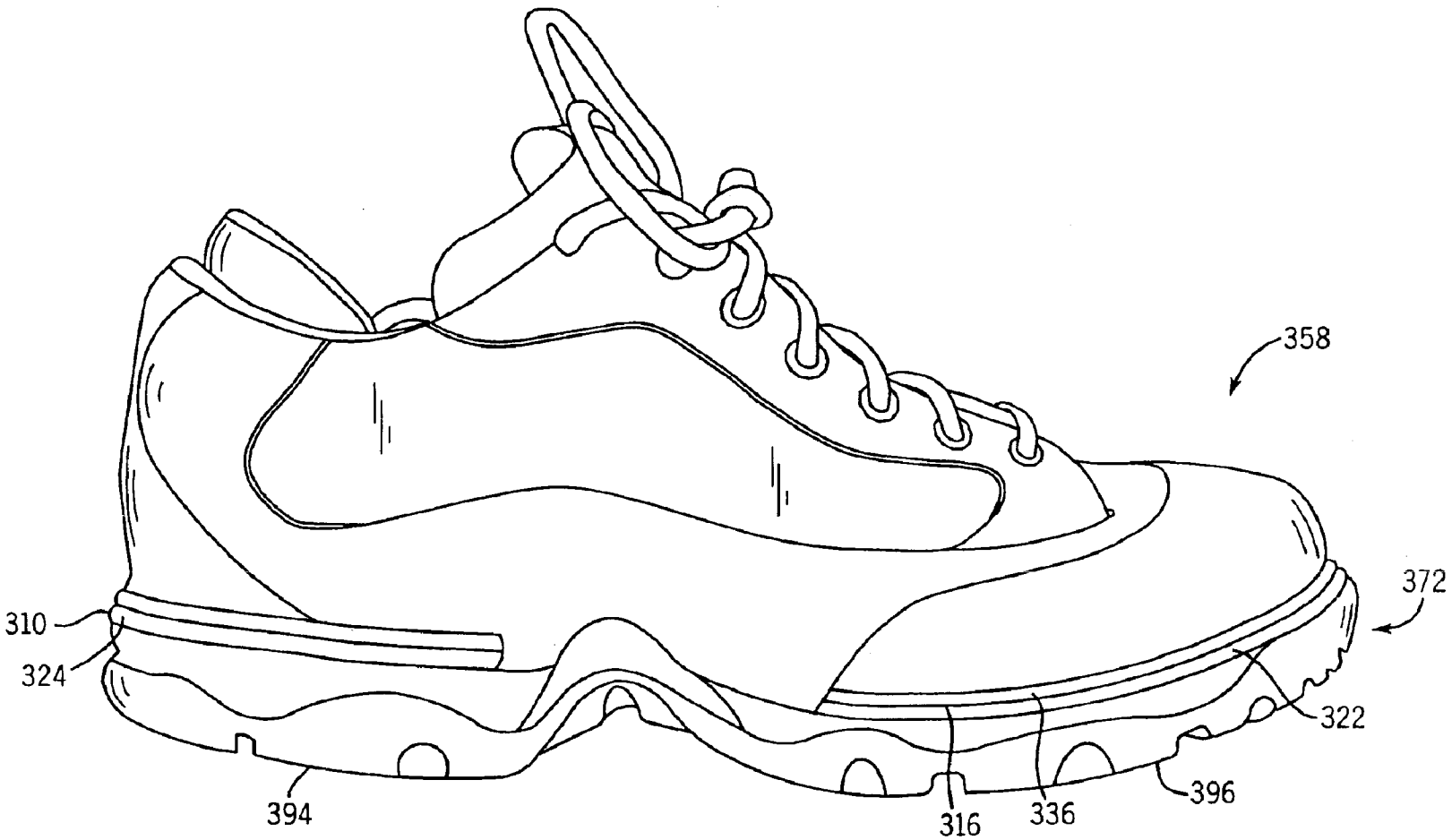
FIG. 18 is a right side view of an article of footwear constructed using the upper/insole assembly shown in FIG. 17.
Figure 19:
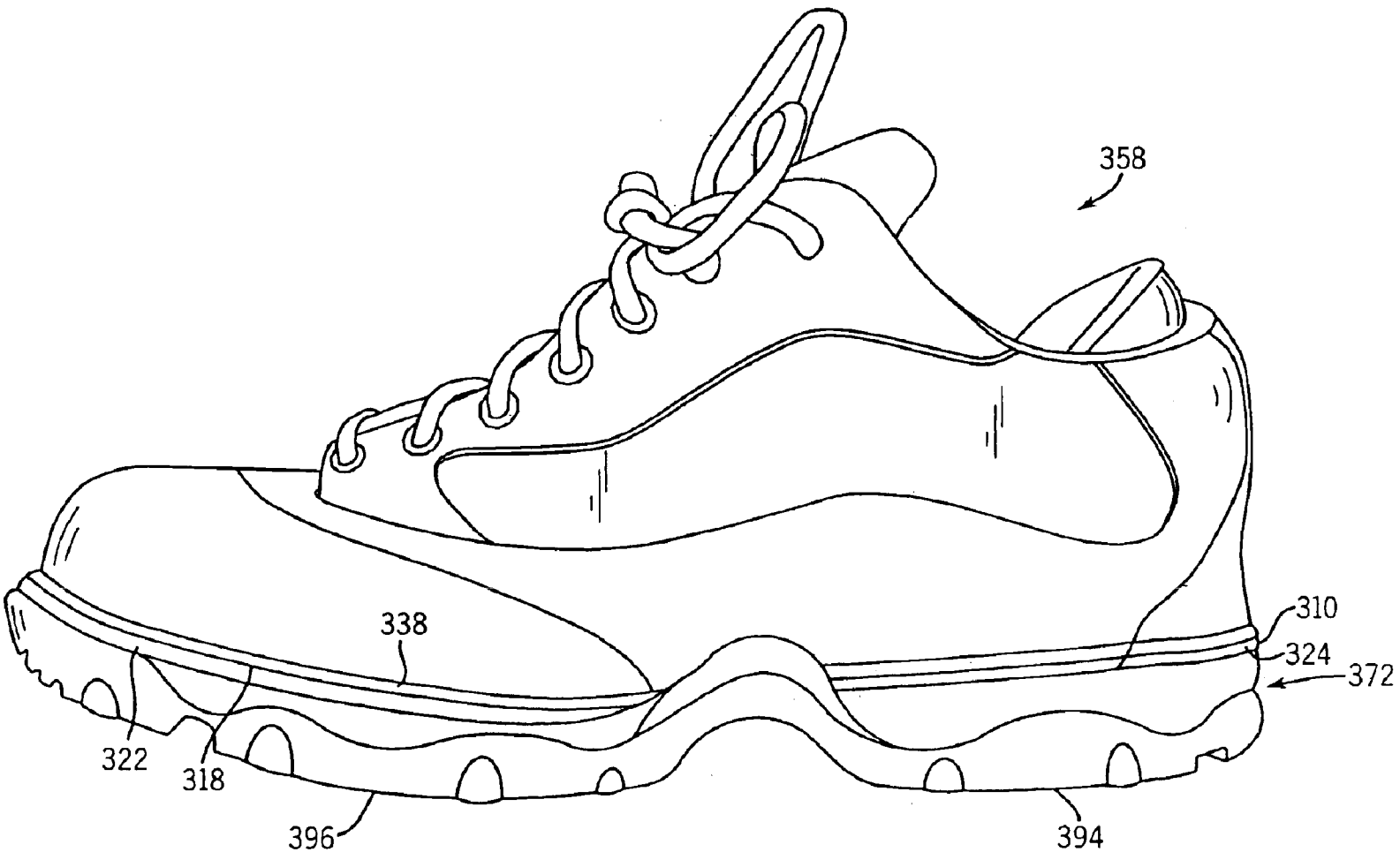
FIG. 19 is a left side view of the article of footwear shown in FIG. 18.

Although the lateral and medial peripheral flanges (336 and 338) are wrapped around lateral and medial peripheral edges (316 and 318) of insole 310 in arch portion 320 of insole 310, in certain preferred upper/insole assemblies, lateral and medial peripheral flanges (336 and 338) do not extend past lateral and medial peripheral edges (316 and 318) in the phalangeal or heel portions (322 and 324) of insole 310 as shown in FIG. 17. In articles of footwear constructed from such an upper/insole assembly such as article of footwear 358 shown in FIGS. 18–19, substantially all to all of heel and/or phalangeal portions (394 and 396) of bottom component 372 are stitched to lateral and medial peripheral flanges (336 and 338) through respective heel and phalangeal portions (322 and 324) of insole 310 along lateral and medial peripheral edges (316 and 318) of insole 10.

It should be understood that the invention is not limited to the particular construction and arrangement of parts herein illustrated and described, but embraces such modified forms as come within the scope of the following claims.

What is claimed is:

1. An article of footwear, comprising:

(a) an upper comprising:

(i) an inner surface;

(ii) an outer surface;

(iii) a lateral peripheral flange; and (iv) a medial peripheral flange; and (b) an insole comprising:

(i) a top surface;

(ii) a bottom surface;

(iii) a lateral peripheral edge;

(iv) a medial peripheral edge;

(v) an arch portion;

(vi) a first portion forward of the arch portion; and (vii) a second portion rearward of the arch portion, wherein at least a portion of the lateral peripheral flange and at least a portion of the medial peripheral flange of the upper are stitched to the insole in the first and second portions but wherein the lateral and medial peripheral flanges of the upper are not stitched to the insole through the arch portion, and further wherein the lateral peripheral flange of the upper is wrapped around the lateral peripheral edge of the insole in the arch portion and the medial peripheral flange of the upper is wrapped around the medial peripheral edge of the insole in the arch portion.

2. The article of footwear according to claim 1, further comprising a bottom component comprising an outsole component and a midsole component, wherein at least a portion of the midsole component is fixed to the upper.

3. The article of footwear according to claim 2, wherein the bottom component further comprises at least one shank that provides support to the arch portion.

4. The article of footwear according to claim 2, wherein the bottom component further comprises a heel portion and the heel portion of the bottom component is stitched to the lateral and medial peripheral flanges of the upper through the second portion of the insole.

5. The article of footwear according to claim 4, wherein the bottom component further comprises at least one shank.

6. The article of footwear according to claim 2, wherein the bottom component further comprises a forward portion and substantially all of the forward portion of the bottom component is stitched to the lateral and medial peripheral flanges of the upper through the first portion of the insole component.

7. The article of footwear according to claim 6, wherein the bottom component further comprises at least one shank.

8. The article of footwear according to claim 6, wherein the bottom component further comprises a heel portion and substantially all of the heel portion of the bottom component is stitched to the lateral and medial peripheral flanges of the upper through the second portion of the insole component.

9. The article of footwear according to claim 8, wherein the bottom component further comprises at least one shank.

10. The article of footwear according to claim 1, wherein at least a portion of the lateral and medial peripheral flanges are wrapped around the lateral and medial peripheral edges of the first portion of the insole and secured to the bottom surface of the first portion of the insole.

11. The article of footwear according to claim 10, further comprising and a bottom component comprising a midsole component, an outsole component, a heel portion, and a forward portion wherein the heel portion of the bottom component is stitched to the lateral and medial peripheral flanges of the upper through the second portion of the insole component and the forward portion of the bottom component is fixed to the forward portion of the insole.

12. The article of footwear according to claim 11, wherein the bottom component further comprises at least one shank.

13. The article of footwear according to claim 10, wherein at least a portion of the lateral and medial peripheral flanges are wrapped around the lateral and medial peripheral edges of the second portion of the insole and secured to the bottom surface of the second portion of the insole.

14. The article of footwear according to claim 1 and a bottom component comprising a midsole component, an outsole component, a heel portion and a forward portion, wherein the forward portion of the bottom component is fixed to the first portion of the bottom surface of the insole and the heel portion of the bottom component is fixed to the second portion of the bottom surface of the insole, and further wherein, the outer surface of the lateral and medial peripheral flanges of the upper contacts the top surface of the bottom component.

15. The article of footwear according to claim 14, wherein the bottom component further comprises at least one shank.

16. The article of footwear according to claim 1, wherein at least a portion of the lateral and medial peripheral flanges are wrapped around the lateral and medial peripheral edges of the second portion of the insole and secured to the bottom surface of the second portion of the insole.

17. The article of footwear according to claim 16, further comprising a bottom component comprising a midsole component, an outsole component, a heel portion, and a forward portion wherein substantially all of the forward portion of the bottom component is stitched to the lateral and medial peripheral flanges of the upper through the first portion of the insole component and the heel portion of the bottom component is fixed to the second portion of the insole.

18. The article of footwear according to claim 17, wherein the bottom component further comprises at least one shank.

19. An article of footwear, comprising:

(a) an upper comprising:
(i) a lateral peripheral flange;
(ii) a medial peripheral flange;

(b) a sole component comprising:
(i) a top surface;
(ii) a bottom surface;
(iii) a lateral peripheral edge;
(iv) a medial peripheral edge;
(v) an arch portion;
(vi) a first portion forward of the arch portion; and
(vii) a second portion rear of the arch portion, wherein at least a portion of the lateral peripheral flange and at least a portion of the medial peripheral flange of the upper assembly are stitched to the sole component in the first and second portions but wherein the lateral and medial peripheral flanges of the upper are not stitched to the sole component through the arch portion.

20. The article of footwear of claim 19 wherein the lateral peripheral flange of the upper is wrapped around the lateral peripheral edge of the sole component in the arch portion and the medial peripheral flange of the upper is wrapped around the medial peripheral edge of the sole component in the arch portion.

21. The article of footwear of claim 19 wherein the lateral and media peripheral flanges are secured to the bottom surface of the arch portion of the sole component.

22. The article of footwear according to claim 19, wherein the sole component is an insole.

23. The article of footwear according to claim 19, wherein the sole component is a full-length insole, the first portion is a phalangeal portion and the second portion is a heel portion.

24. The article of footwear according to claim 19, wherein the sole component is a one-piece insole.

25. The article of footwear according to claim 19, further comprising an outsole component and a midsole component coupled to the upper.

26. The article of footwear according to claim 25, further comprises at least one shank coupled to the sole component and the outsole component.

27. The article of footwear according to claim 19, further comprising an outsole component and a midsole component, the midsole component is stitched between the outsole component and the lateral and medial peripheral flanges of the upper.

28. The article of footwear according to claim 19, further comprising an outsole component having a heel portion, the heel portion of the outsole component is stitched to the lateral and medial peripheral flanges of the upper through the second portion of the sole component.

29. The article of footwear according to claim 19, further comprising an outsole having a forward portion, the forward portion being stitched to the lateral and medial peripheral flanges of the upper through the first portion of the sole component.

30. An article of footwear, comprising:

(a) an upper comprising:
(i) a lateral peripheral flange;
(ii) a medial peripheral flange;

(b) a first sole component comprising:
(i) a first lateral peripheral edge;
(ii) a second medial peripheral edge;
(iii) a first arch portion;
(iv) a first forward portion forward of the first arch portion;
(v) a first heel portion rear of the first arch portion, (c) a second sole component adjacent to the first sole component, and comprising:
(i) a second lateral peripheral edge;
(ii) a second medial peripheral edge;
(iii) a second arch portion;
(iv) a second forward portion forward of the second arch portion; and
(v) a second heel portion rear of the second arch portion.

wherein at least a portion of the lateral peripheral flange and at least a portion of the medial peripheral flange of the upper are stitched to at least one of the first sole component in the first forward and heel portions and the second sole component in the second front and heel portions but wherein the lateral and medial peripheral flanges of the upper are not stitched to the first or second sole components through the first or second arch portions, and further wherein the lateral peripheral flange of the upper is wrapped around at least one of the first and second lateral peripheral edges in the arch portion and the medial peripheral flange of the upper is wrapped around at least one of the first and second medial peripheral edges in the arch portion.

31. The article of footwear of claim 30 wherein the first sole component is an insole.

32. The article of footwear of claim 30 wherein the second sole component is a midsole.

33. The article of footwear of claim 30, further comprising an outsole having a third heel portion a third arch portion and a third forward portion, the lateral and peripheral flanges of the upper being stitched to at least a portion of the third heel and forward portions but not through the third arch portion.

* * * * *